US008579034B2

(12) United States Patent
Berner, Jr. et al.

(10) Patent No.: US 8,579,034 B2
(45) Date of Patent: Nov. 12, 2013

(54) RISER TENSIONER SYSTEM

(75) Inventors: Paul C. Berner, Jr., Houston, TX (US); Sammy Russell Moore, Lubbock, TX (US); William Robert Cox, Magnolia, TX (US)

(73) Assignee: The Technologies Alliance, Inc., Houston, TX (US)

( * ) Notice: Subject to any disclaimer, the term of this patent is extended or adjusted under 35 U.S.C. 154(b) by 0 days.

(21) Appl. No.: 13/439,421

(22) Filed: Apr. 4, 2012

(65) Prior Publication Data

US 2012/0247783 A1 Oct. 4, 2012

Related U.S. Application Data

(60) Provisional application No. 61/471,530, filed on Apr. 4, 2011.

(51) Int. Cl.
*E21B 19/00* (2006.01)

(52) U.S. Cl.
USPC ..... 166/355; 166/367; 166/75.14; 166/241.6; 405/224.4

(58) Field of Classification Search
USPC ..... 166/355, 351, 352, 367, 85.1, 85.5, 166/75.14, 241.6; 405/184.4, 224.2, 224.4
See application file for complete search history.

(56) References Cited

U.S. PATENT DOCUMENTS

| | | | | | |
|---|---|---|---|---|---|
| 4,004,532 | A | * | 1/1977 | Reynolds | 114/256 |
| 4,272,059 | A | | 6/1981 | Noerager et al. | |
| 4,362,438 | A | * | 12/1982 | Spink | 405/195.1 |
| 4,379,657 | A | * | 4/1983 | Widiner et al. | 405/224.4 |
| 4,655,433 | A | | 4/1987 | Peppel et al. | |
| 4,729,694 | A | | 3/1988 | Peppel | |
| 4,733,991 | A | * | 3/1988 | Myers | 405/224.2 |
| 4,787,778 | A | * | 11/1988 | Myers et al. | 405/224.4 |
| 4,799,827 | A | * | 1/1989 | Jaqua | 405/224.4 |
| 4,883,387 | A | * | 11/1989 | Myers et al. | 405/224.4 |
| 4,883,388 | A | * | 11/1989 | Cherbonnier | 405/195.1 |
| 4,886,397 | A | * | 12/1989 | Cherbonnier | 405/195.1 |
| 5,366,324 | A | | 11/1994 | Arlt et al. | |
| 5,551,803 | A | * | 9/1996 | Pallini et al. | 405/223.1 |
| 5,846,028 | A | * | 12/1998 | Thory | 405/195.1 |
| 5,950,737 | A | * | 9/1999 | Chou et al. | 175/5 |
| 6,045,296 | A | * | 4/2000 | Otten et al. | 405/195.1 |
| 6,260,625 | B1 | * | 7/2001 | Phan et al. | 166/355 |
| 6,343,893 | B1 | * | 2/2002 | Gleditsch | 405/196 |

(Continued)

FOREIGN PATENT DOCUMENTS

| | | | |
|---|---|---|---|
| FR | 2729432 | A1 | 7/1996 |
| WO | WO2011/018713 | A2 | 2/2011 |
| WO | WO2011/018713 | A3 | 2/2011 |
| WO | WO2011/133552 | A1 | 10/2011 |

*Primary Examiner* — Matthew Buck
(74) *Attorney, Agent, or Firm* — Bracewell & Giuliani LLP

(57) ABSTRACT

A riser tensioner system maintains a tensile force in a riser having an axis and extending from a subsea wellhead assembly through an opening in a floating platform deck. The tensioner includes a plurality of tensioner legs having lower ends mounted to the deck, and upper ends having slots formed therein to receive leg attachment plates having an opening therein through which a tubular support ring passes. A plurality of cylinders extend between the tubular support ring and a tensioner ring and couple to the support ring with cylinder attachment plates through which the tubular support ring passes. An upper end of each cylinder pivots about the mounting point, and a lower end of each cylinder adjustably mounts to the tensioner ring.

22 Claims, 11 Drawing Sheets

(56) References Cited

U.S. PATENT DOCUMENTS

| | | | | |
|---|---|---|---|---|
| 6,708,765 | B1 | 3/2004 | Eilertsen | |
| 8,157,013 | B1 * | 4/2012 | Trent | 166/355 |
| 8,162,062 | B1 * | 4/2012 | Barone et al. | 166/355 |
| 8,191,636 | B2 * | 6/2012 | Coles | 166/355 |
| 2002/0000321 | A1 * | 1/2002 | Reynolds | 166/355 |
| 2003/0102134 | A1 * | 6/2003 | Reynolds | 166/379 |
| 2004/0031614 | A1 | 2/2004 | Kleinhans | |
| 2005/0147473 | A1 * | 7/2005 | Pallini et al. | 405/224.4 |
| 2006/0180314 | A1 * | 8/2006 | Williams | 166/355 |
| 2008/0031692 | A1 * | 2/2008 | Wybro et al. | 405/224.4 |
| 2008/0166186 | A1 * | 7/2008 | Pallini et al. | 405/224.4 |
| 2008/0304916 | A1 * | 12/2008 | Crotwell et al. | 405/224.2 |
| 2009/0145611 | A1 * | 6/2009 | Pallini et al. | 166/355 |
| 2011/0170955 | A1 * | 7/2011 | Koos et al. | 405/224.4 |
| 2012/0217016 | A1 * | 8/2012 | Von Der Ohe et al. | 166/355 |

* cited by examiner

RISER TENSIONER SYSTEM

This application claims priority to and the benefit of U.S. Provisional Application No. 61/471,530, filed on Apr. 4, 2011, entitled "Riser Tensioner System" to Paul C. Berner, Jr., et al, which application is hereby incorporated in its entirety herein by reference.

FIELD OF THE INVENTION

The present invention relates in general to marine riser tensioners and, in particular, to a riser tensioner frame for a riser tensioner system.

BRIEF DESCRIPTION OF RELATED ART

Offshore production platforms must support production risers from oil or gas wells that extend to the platform from subsea wells. This is accomplished through the use of riser tensioners or riser tensioning mechanisms that hold the riser in tension between the production platform and the wellhead. The riser tensioning mechanism maintains the riser in tension so that the entire weight of the riser is not transferred to the wellhead and to prevent the riser from collapsing under its own weight. The tensioning mechanism must therefore exert a continuous tensional force on the riser that is maintained within a narrow tolerance. Often, the production platform is a floating structure that moves laterally, vertically, and rotationally with respect to the fixed equipment at the seafloor. Thus, the riser tensioner mechanism must simultaneously provide support to a riser while accommodating the motion of the surface facility or platform.

Risers extend through a platform in a well slot, an opening in a deck of the platform for passage of the riser string. At a defined elevation within a platform's well slot, a riser's lateral motion is restricted by a guidance device that reacts laterally against a riser, preventing lateral displacement of the riser while still permitting vertical movement of the riser in order to keep an upper termination of the riser within the boundaries of the well slot. The portion of a riser's upper termination above and below the guidance device can still move laterally as the riser rotates about the location of the lateral guidance device. The magnitude of the lateral motion of the upper termination of the riser is directly proportional to its elevation above or below the guidance device. It is desirable to have the guidance device located proximate to equipment coupled to the upper termination of the riser to decrease movement of the portion above the guidance device. As a result, it may be desirable to place the guidance device on an upper portion of a riser tensioner frame of the riser tensioner system rather than on a lower platform deck where the tensioner system is mounted. This may create problems as the riser tensioner frame must be sufficiently strong to react to the lateral loading by the riser.

Riser tensioner system frames may comprise a multitude of components. In some prior art embodiments, the tensioner frame includes a tensioner frame ring formed of a multitude of straight elements welded together at angled joints. Legs extend from the deck into the well slot to mount to the tensioner frame ring The legs will join the tensioner frame ring at coped joints. Generally, each component is welded together and, due to the angled and coped joints, this makes for difficult fabrication. In addition, the angles at each joint transfer the loading of the tensioner frame from the structural elements to the welds joining each element. Thus, the strength of the tensioner is placed on welds that may be located in positions and angles that are difficult to form. Improper welding may lead to a frame with a significantly reduced strength that is prone to early failure.

Riser tensioner systems include tensioner elements that provide the tensioning force on the riser. Some tensioner systems attach lower ends of the tension elements to the riser below the guidance device and extend and contract the tensioner elements as the tension force is applied to a riser. Since this lower attachment point is at an elevation different from that of the guidance device, each tension element must be capable of rotating about its upper and lower attachment points to allow its lower end to follow the lateral motion of the riser. Therefore, the tension element's upper and lower attachment points must utilize flexible connections to accommodate relative lateral motion of a riser's upper termination while still being capable of applying a tensioning force to a riser tensioner system.

In addition, the tensioner elements are often coupled to the tensioner frame ring through lugs mounted to the tensioner frame ring. Paired shackles may then couple the tensioner elements to the lugs to allow for lateral motion of the tension element. The lugs are mounted to the tensioner frame ring and, due to the shape and fabrication of the tensioner frame ring, may be difficult to place and weld properly. In addition, the shackles provide an undesired increase in length of the tensioner element that necessitates a taller tensioner system. Still further, the shackles are exposed to environmental conditions that cause rapid wear of the shackles at the interfacing surfaces of the shackles. In some embodiments, the tensioner elements are coupled with swivel bearings however, the arrangement of the tensioner frame ring, lugs, and frame legs may cause eccentric loading of the swivel bearing that leads to early failure. In some cases, the placement of the lugs may require removal of the tensioner frame legs to allow for removal and replacement of the tensioner element. These issues make fabrication and in place repair of riser tensioner systems difficult.

A floating production system usually has multiple risers running between seafloor terminations and a surface facility, with each utilizing a riser tensioner system. Therefore, typical floating production systems may require multiple riser tensioner systems supporting production, injection, satellite flowline, drilling, import, and export riser systems. Thus, it is desirable to have tensioners of a size to allow use of separate tensioners for each riser placed on the same platform. Riser tensioner systems must also have a high degree of operational uptime for extended periods, usually several years. As a result, maintenance and possible tensioner element replacement during system operation must be possible. Therefore, there is a need for a riser tensioner that can overcome the problems induced by the structural limitations of the tensioner frame in the prior art.

SUMMARY OF THE INVENTION

These and other problems are generally solved or circumvented, and technical advantages are generally achieved, by preferred embodiments of the present invention that provide a marine riser tensioner, and a method for placing and operating the same.

In accordance with an embodiment of the present invention, a tensioner for maintaining a tensile force in a riser having an axis and extending from a subsea wellhead assembly through an opening in a floating platform deck is disclosed. The tensioner including a plurality of tensioner legs, each having a lower end for mounting to the deck. The tensioner also includes a circular support ring formed of at least one curved segment positioned proximate to upper ends of the tensioner legs. The tensioner further includes a plurality of leg attachment plates, each having an opening formed therethrough, the support ring passing through the opening in each leg attachment plate so that each leg attachment plate is proximate to a respective one of the tensioner legs. A slot is formed in the upper end of each tensioner leg, each slot corresponding to one of the leg attachment plates, and a lower end of each leg attachment plate mounted in one of the corresponding slots. A tensioner ring is positioned axially below the support ring for engaging the riser. A plurality of cylinders extend between the support ring and the tensioner ring. The tensioner includes a plurality of cylinder attachment plates, each having an opening formed therethrough. The support ring passes through the opening in each of the cylinder attachment plates so that each cylinder attachment plate is proximate to a respective one of the cylinders. An upper end of each cylinder is mounted to a corresponding one of the cylinder attachment plates so that the cylinder may pivot about a mounting point, and a lower end of each cylinder is adjustably mounted to the tensioner ring.

In accordance with another embodiment of the present invention, a tensioner for maintaining a tensile force in a riser having an axis and extending from a subsea wellhead assembly through an opening in a floating platform deck is disclosed. The tensioner includes a circular support ring formed of at least one curved segment, and a plurality of tensioner legs, each having an upper end for mounting to the support ring. The tensioner also includes a base frame having at least two linear members for mounting to the deck, each linear member having lower ends of at least two legs rigidly mounted thereto. A plurality of centralizers mount to the support ring and extending radially inward to constrain lateral shift, each centralizer including a roller on an interior end for engaging the riser.

In accordance with yet another embodiment of the present invention, a method for placing a riser tensioner assembly and tensioning a riser passing through an opening in a deck of a platform is disclosed. The method provides a riser tensioner assembly having a rigid support frame, a plurality of cylinders supported by the rigid support frame, and lateral guidance assembly, the rigid support frame being a modular unit including a plurality of legs coupled to a base frame for mounting to the deck, and the cylinders coupled to the rigid support frame with swivel bearings so that the loading of the rigid support frame is along an axis of the plurality of legs. The method lifts the riser tensioner assembly as a unit onto the platform and couples the riser tensioner assembly to a deck of the platform at a platform opening. The method couples the riser to a tensioner ring of the riser tensioner assembly. The tensioner ring is supported by the plurality of cylinders extending from the rigid support frame to the tensioner ring. The method supports the riser at least partially with the riser tensioner assembly rigid support frame so that the weight of the riser transfers to the deck along axes of the tension members and tubular members of the rigid support frame. The method transfers loads induced by movement of the riser to the deck along axes of the tension members and the tubular members of the rigid support frame as the riser tilts relative to the deck in response to motion of the deck.

The disclosed embodiments provide numerous advantages. For example, the resulting tensioner system's height is less than one that utilizes prior art designs, such as those using dual shackles to couple the cylinders to the frame. This decreases the required vertical spacing between decks on a platform, allowing for minimal vertical spacing of the decks. The riser tensioner system is a complete put-together assembly, function and pressure tested prior to shipment to an offshore facility. This eliminates costly offshore assembly and possible system damage and contamination due to the offshore environment. The disclosed embodiments also allow for installation and repair of the riser tensioner system without the need of a risky keel hauling process. Thus, on platforms with multiple installed risers, the riser tensioner system disclosed herein may be installed, repaired, or removed without shutting in production through the platform during the process as may otherwise be required during a standard keel hauling process.

Unlike prior art designs, the primary load path of the disclosed tensioner passes directly from the frame, through the leg attachment plate and into the frame leg, without placing primary structural load bearing on the joining welds mounting each element to the next. This provides a stronger more efficient frame structure. It is more efficient in transferring loads, less sensitive to deflection induced stress hot-spots, easier to fabricate and inspect, and less expensive. In addition, mounting the pivoting member, i.e. the swivel bearing, to the stationary tensioner frame will cause the tensioning loads to remain perpendicular to the pivoting member and the tensioner frame, thereby eliminating eccentric loading of the pivoting mount.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted inasmuch as such details are not considered necessary to obtain a complete understanding of the present invention, and are considered to be within the skills of persons skilled in the relevant art.

Figure 1A:
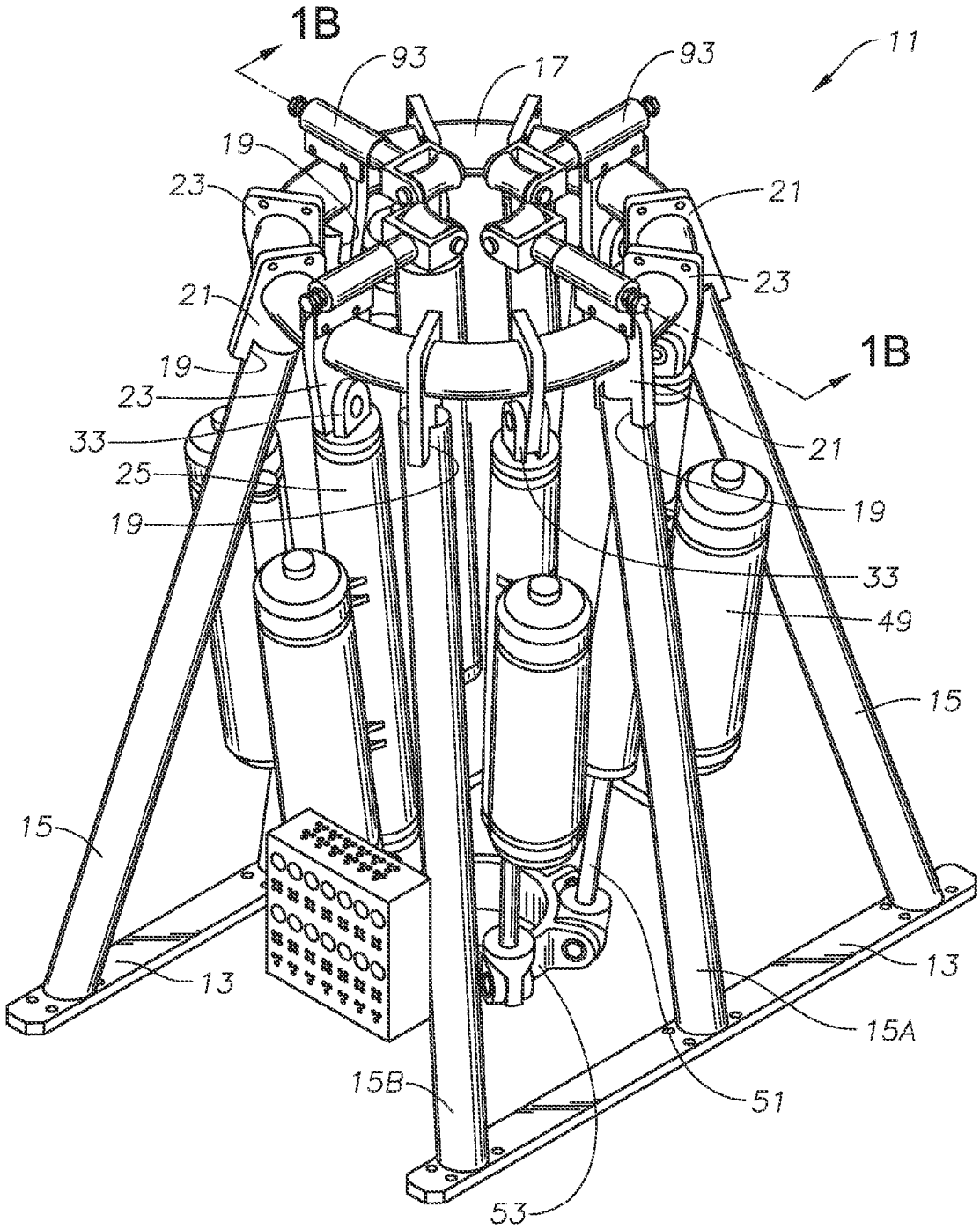
FIG. 1A is a schematic illustration of a riser tensioner system in accordance with an embodiment of the present invention.

Referring to FIG. 1A, there is shown a riser tensioner system 11 in accordance with an embodiment of the present invention. As shown, riser tensioner system 11 may be a production, injection, export, drilling, or other type of riser tensioner system. Referring to FIG. 1A, riser tensioner system 11 may include a base frame 13. Base frame 13 may be a pair of rails as shown in FIG. 1A and FIG. 9D that are then further coupled to a deck of a floating platform. In alternative embodiments, base frame 13 may be square, such as base frame 13A of FIGS. 8 and 9A, chevron shaped, such as base frame 13B of FIG. 9B, circular, such as base frame 13C of FIG. 9C, rectangular, such as base frame 13E of FIG. 9E, or any suitable shape for the particular floating platform and riser being tensioned by riser tensioner system 11.

Referring to FIG. 1A, riser tensioner system 11 also includes frame legs 15 extending between base frame 13 and a frame ring 17. In the illustrated embodiment, six frame legs 15 extend between base frame 13 and frame ring 17. A person skilled in the art will understand that more or fewer frame legs 15 may be used depending on the particular application of riser tensioner system 11. Frame legs 15 mount to base frame 13 in any suitable manner such as by bolting through plates (not shown), or as illustrated by welding a lower end of each leg 15 to base frame 13. In the exemplary embodiment, frame ring 17 has a diameter that is less than a width of base frame 13. Frame legs 15 angle inward from the mounting point at base frame 13 to the diameter of frame ring 17. The lower end of each frame leg 15 is formed at an angle to accommodate the different angle at which each frame leg 15 must be positioned to extend between base frame 13 and frame ring 17. As shown in FIGS. 9A-9E, the angle at the lower end of each frame leg may vary in response to base frame 13 selected for the particular application.

Referring again to FIG. 1A, an upper end of each frame leg 15 includes a slot 19. Slot 19 may be formed in the upper end of each frame leg 15 in any suitable manner, such as by machining. Each slot 19 will be formed at a predetermined angle based on the positioning of the corresponding frame leg 15 to frame ring 17. For example, slot 19 of frame leg 15A may be formed parallel to an axis passing through the center of frame leg 15A; in contrast, slot 19 of frame leg 15B may not be parallel to an axis passing through the center of frame leg 15B. Instead, slot 19 of frame leg 15B will be angled so that a leg attachment plate 21 inserted into slot 19 of frame leg 15B will angle toward frame ring 17 and a face of leg attachment plate 21 will meet a cross section of frame ring 17 at a perpendicular angle, as shown in FIGS. 9A-9E, and, in particular, in FIGS. 9D and 9E. Preferably, a load path will pass from frame ring 17 to leg attachment plate 21 to leg 15 along an axis of each leg 15. In the exemplary embodiment, the edges of slot 19 are beveled to aid in subsequent welding of leg attachment plate 21 to frame leg 15. A person skilled in the art will understand that alternative embodiments may not include beveled edges.

Frame ring 17 may be a ring formed of a continuously curved tubular member. In the illustrated embodiment, frame ring 17 is a single tubular member bent in an induction bending process to substantially maintain the nominal tube radius of the tubular member during the bending process. Following bending of the tubular member into the circular shape of frame ring 17, the ends are welded together to complete the ring. Alternative embodiments may include two tubular members bent into to two 180 degree halves of the 360 degree circle, three 120 degree thirds of the 360 degree circle, four 90 degree quarters of the 360 degree circle, or six 60 degree sixths of the 360 degree circle. Bending frame ring 17 in this manner significantly reduces the number of welds necessary to construct the support ring and lends itself to an automated easily fabricated and inspected process. Prior to joining the tubular sections to form frame ring 17, the tubular sections are passed through a plurality of leg attachment plates 21 and a plurality of cylinder attachment plates 23. Frame ring 17 is then bent and welded together as described above. Alternatively, the tubular sections may be bent prior to placement of leg attachment plates 21 and cylinder attachment plates 23 on frame ring 17. Following bending of frame ring 17, leg attachment plates 21 and cylinder assembly attachment plates 23 are positioned and mounted around frame ring 17 corresponding to the locations of frame legs 15 and cylinders 25, described in more detail below.

Figure 1B:
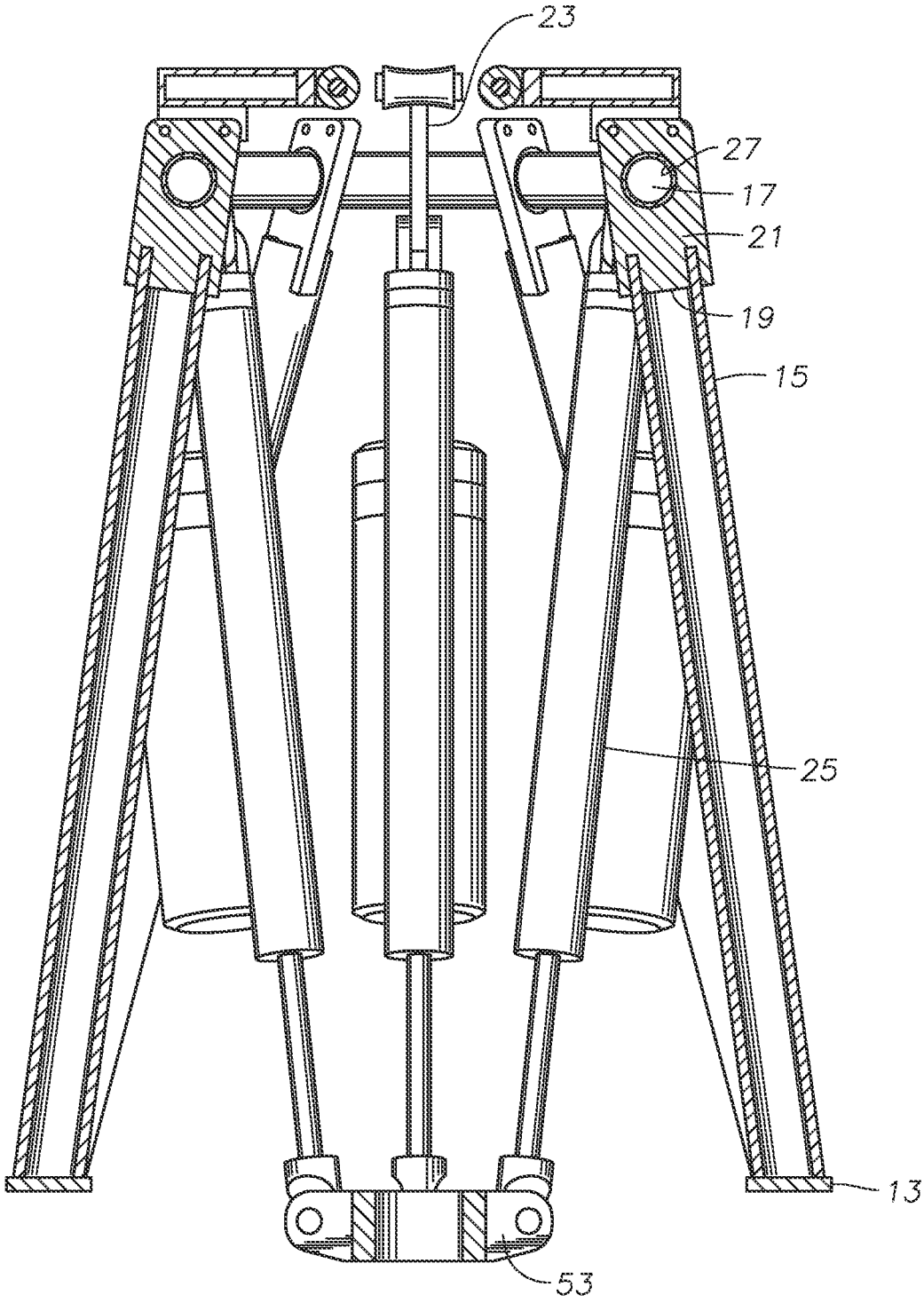
FIG. 1B is a sectional view of the riser tensioner system taken along line 1B-1B of FIG. 1A.
Figure 2A:
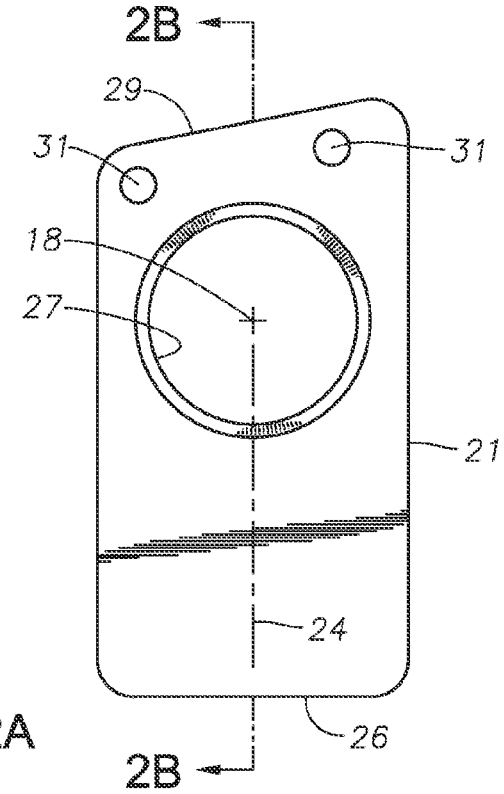
FIG. 2A is a schematic view of a leg attachment plate of the riser tensioner system of FIG. 1A.
Figure 2B:
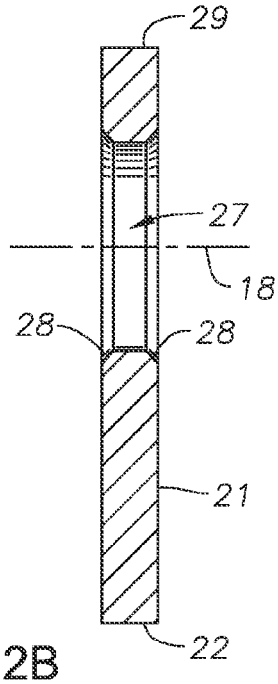
FIG. 2B is a sectional view of the leg attachment plate of FIG. 2A taken along line 2B-2B.

Referring to FIGS. 2A and 2B, each leg attachment plate 21 mounts in a corresponding slot 19 of the respective frame leg 15. Leg attachment plate 21 has a width 22 such that leg attachment plate 21 will substantially fill slot 19 (FIG. 1A). As shown in FIG. 2A, leg attachment plate 21 is substantially rectangular and defines a bore 27 passing through leg attachment plate 21. Bore 27 has a diameter approximately equivalent to the exterior tubular diameter of frame ring 17 (FIG. 1A) such that frame ring 17 may pass through bore 27 of leg attachment plate 21 as shown in FIG. 1B. In the illustrated embodiment of FIGS. 2A and 2B, bore 27 is beveled 28 to facilitate welding of leg attachment plate 21 to frame ring 17. Bore 27 is formed proximate to an upper end of leg attachment plate 21 such that bore 27 will not be blocked by sides of slot 19 of frame leg 15 when leg attachment plate 21 is fully inserted into slot 19 when a lower end of leg attachment plate 21 abuts the end of slot 19 as shown in FIG. 1A and FIG. 1B. As shown in FIG. 2A, the section of FIG. 2B is taken along a centerline 24, equidistant between side edges of leg attachment plate 21 and normal to a lower edge 26. Centerline 24 passes through an axis 18 of bore 27.

Referring to FIG. 2A, an upper end 29 of leg attachment plate 21 is sloped so that end 29 will be substantially horizontal after mounting leg attachment plate to frame ring 17 and frame leg 15. Leg attachment plate 21 may include pin bores 31 formed proximate to upper end 29 and in between end 29 and bore 27. Pin bores 31 may be used for lifting riser tensioner system 11 with external equipment or for mounting of additional equipment and structure to riser tensioner system 11.

Referring to FIG. 1B, leg attachment plates 21 and cylinder assembly attachment plates 23 mount to frame ring 17 as shown herein. During formation and assembly of frame ring 17, the tubular member that will become frame ring 17 is inserted through each leg attachment plate 21 and cylinder assembly attachment plate 23. The tubular member that becomes frame ring 17 is then bent in the induction bending process described above, and the ends of each tubular member are joined together, such as by welding. Alternatively, leg attachment plates 21 and cylinder assembly attachment plates 23 may be inserted onto frame ring 17 following the induction bending process, but before ends of frame ring 17 are joined. Frame ring 17 is then positioned relative to base frame 13 and leg attachment plates 21 and cylinder assembly attachment plates 23 are positioned around frame ring 17 to properly align with frame legs 15 or the position of a cylinder assembly 25, respectively. Each leg attachment plate 21 or cylinder assembly attachment plate 23 is then mounted to the frame ring 17, such as by welding, thereby securing it in place on frame ring 17 for further attachment to either frame legs 15 or cylinder assemblies 25. Again, this significantly reduces the number of welds and allows for minimization of heat input and potential distortion of components during the fabrication process and provides a support frame that is less tolerance sensitive than prior art designs.

Figure 3A:
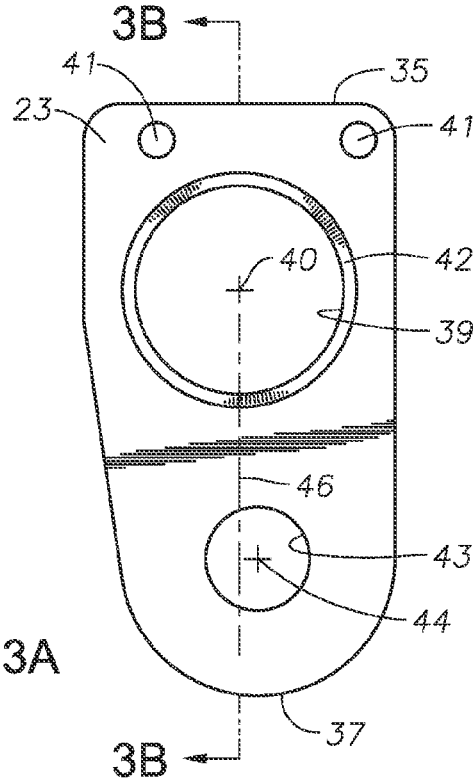
FIG. 3A is a schematic view of a cylinder assembly attachment plate of the riser tensioner system of FIG. 1A.
Figure 3B:
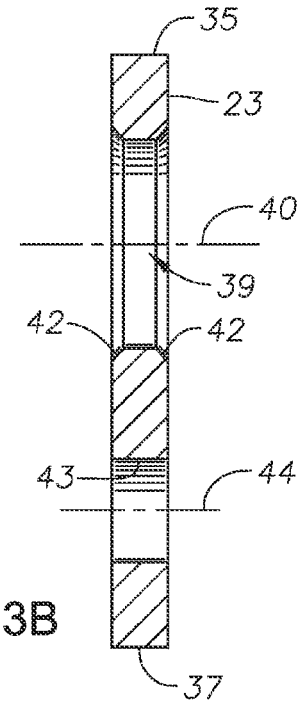
FIG. 3B is a sectional view of the cylinder assembly attachment plate of FIG. 3A taken along line 3B-3B.

As illustrated in FIG. 1A, each cylinder assembly attachment plate 23 couples to a corresponding cylinder 25 through a clevis hanger 33. Referring to FIG. 3A and FIG. 3B, each cylinder assembly attachment plate 23 has a width sufficient to bear the axial loading applied by cylinders 25 and a coupled riser. Cylinder assembly attachment plate 23 has an upper end having a substantially rectangular profile 35 and a rounded lower end 37. A cylinder plate bore 39 having an axis 40 is formed in the upper end of cylinder assembly attachment plate 23. Similar to bore 27 of leg attachment plate 21, cylinder plate bore 39 has a diameter approximately equivalent to the exterior tubular diameter of frame ring 17 (FIG. 1A) such that frame ring 17 may pass through cylinder bore 39 of cylinder assembly attachment plate 23. In the illustrated embodiment of FIGS. 3A and 3B, cylinder bore 39 is beveled 42 to facilitate welding of cylinder assembly attachment plate 23 to frame ring 17. Cylinder assembly attachment plate 23 may include pin bores 41 formed proximate to upper end 35 and in between end 35 and bore 39. Pin bores 41 may be used for lifting riser tensioner system 11 with external equipment or for mounting of additional equipment and structure to riser tensioner system 11. In the illustrated embodiment, pin bores 41 are of a similar size and shape as pin bores 31 of leg attachment plate 21. In this manner, similar mounting structure of additional equipment may be used to mount to either cylinder assembly attachment plate 23 or leg attachment plate 21.

Figure 5:
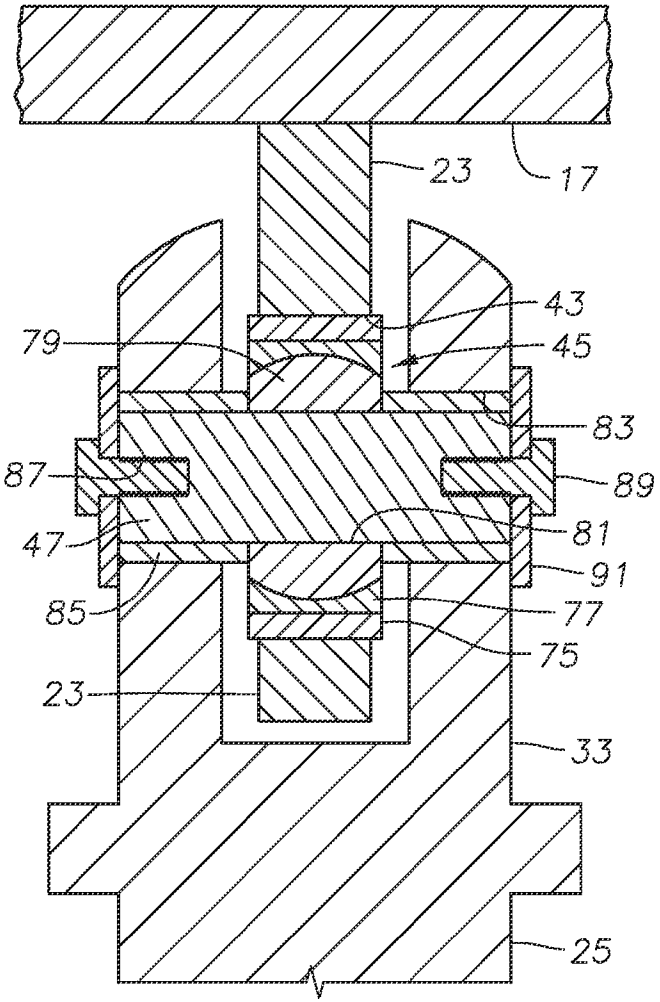
FIG. 5 is a sectional view of the mounting of an upper end of a cylinder to the riser tensioner system of FIG. 1A.

Each cylinder assembly attachment plate 23 defines a swivel bore 43 having an axis 44 in a lower portion of cylinder assembly attachment plate 23 proximate to lower end 37. Swivel bore 43 is of a size and shape to accommodate a swivel bearing 45 (not shown) through which a cylinder pin 47 (not shown) will be inserted to couple cylinder 25 to cylinder assembly attachment plate 23 and frame ring 17 as shown in FIG. 5. A centerline 46 equidistant between side edges of cylinder plate 23 and normal to upper edge 35 passes through axis 40 of bore 39 but is offset relative to axis 44 of swivel bore 43. Referring to FIG. 3A, swivel bore 43 may be offset from centerline 46 and axis 40 of cylinder bore 39 such that upper end 35 will be substantially horizontal following assembly of cylinder assembly attachment plate 23 to frame ring 17 and cylinder 25. This maximizes the strength of the frame rather than requiring the frame to accommodate eccentric loads through the tensioner elements. In addition, by minimizing the size and structure of the connection elements, the addition of protective sleeves over essential components, such as swivel bearing 79 (not shown) may be accomplished. This enhances the life expectancy of the interface between frame ring 17 and cylinder 25.

Figure 4A:
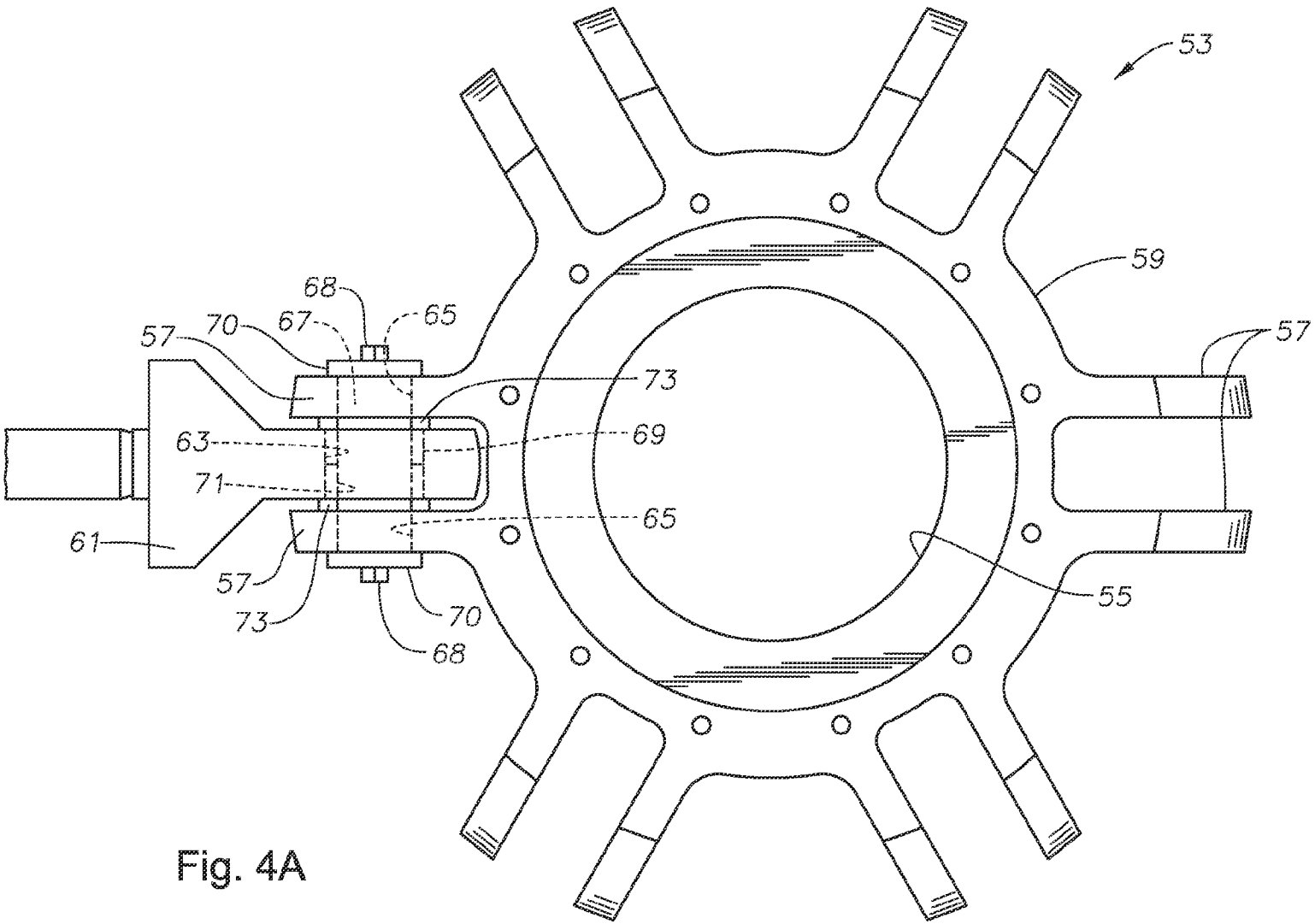
FIGS. 4A and 4B are top and side views of a tensioner ring of the riser tensioner system of FIG. 1A.
Figure 4B:
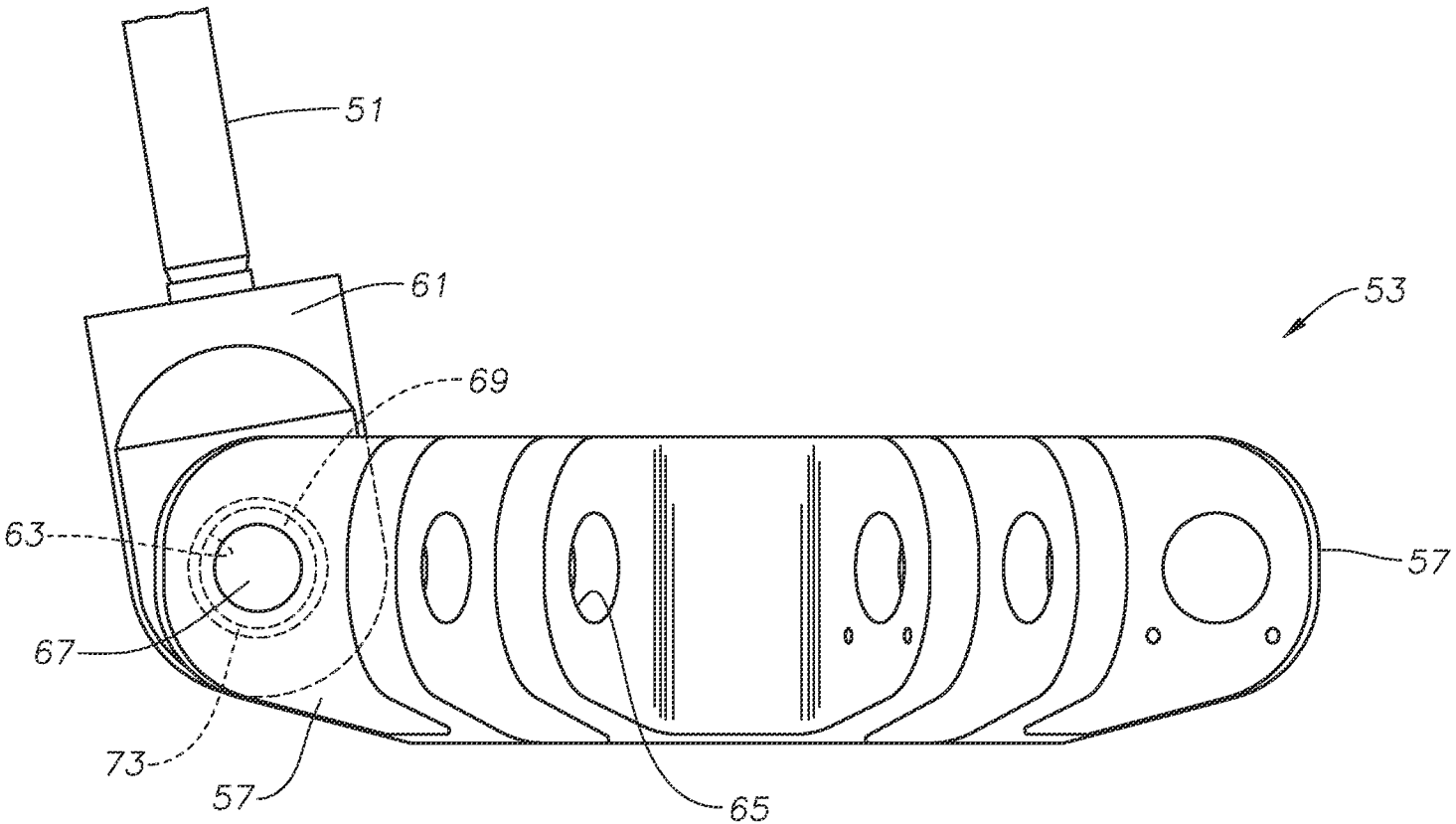

Referring again to FIG. 1A, cylinders 25 may include accumulators 49 and cylinder rods 51. Accumulators 49 may couple to cylinders 25 through accumulator saddles welded to the cylinders, through the use of bracket and strap systems that strap accumulators 49 to corresponding cylinders 25, or any other suitable means to secure accumulators 49 to cylinders 25. In the illustrated embodiment, cylinder rods 51 extend from a lower end of cylinders 25 and couple to a tension ring 53 axially beneath frame ring 17. Referring to FIG. 4A and FIG. 4B, tension ring 53 comprises a ring having an inner diameter 55 of a sufficient size to accommodate a marine riser (not shown). The marine riser will pass through tension ring 53 and secure to tension ring 53 at inner diameter 55. A plurality of clevis hangers 57 extend radially outward from an exterior diameter surface 59 of tension ring 53. Each clevis hanger 57 has a clevis hanger bore 65 through a center of each leg of a respective clevis hanger 57. A center of each clevis hanger bore 65 is aligned with the clevis hanger bore 65 of the paired leg of each clevis hanger 57. In this manner, a pin 67 may extend through each clevis hanger bore 65 of the paired legs of each clevis hanger 57. Pin 67 has a diameter approximately equivalent to the diameter of clevis hanger bore 65.

A clevis eye 61 mounts to a lower end of cylinder rod 51 proximate to tension ring 53. Clevis eye 61 has a clevis eye bore 63 through a center of clevis eye 61. Clevis eye bore 63 has a larger diameter than the diameter of clevis hanger bore 65. A tensioner ring bushing 69 is inserted into clevis eye bore 63 substantially filling clevis eye bore 63. Tensioner ring bushing 69 defines a bushing bore 71 having a diameter approximately equivalent to the diameter of clevis hanger bore 65. In the exemplary embodiment, tensioner ring bushing 69 is a split bushing that, when inserted into clevis eye bore 63, will fill the gap and centralize clevis eye 61 between the paired legs of clevis hanger 57. Flanges 73 are formed on exterior ends of tensioner ring bushing 69 and have a diameter larger than that of clevis eye bore 63 such that flanges 73 define interior and exterior shoulders. Interior shoulders of flanges 73 abut an exterior surface of clevis eye 61, and exterior shoulders of flanges 73 abut interior surfaces of clevis hinge 57, substantially filling the gap between paired legs of a corresponding clevis hanger 57. In the exemplary embodiment, tensioner ring bushing 69 may be a composite bushing having material properties that will allow tensioner ring bushing 69 to flex at an angle to the line of cylinder rod 51.

During assembly clevis eye 61 will insert into the gap between paired legs of a corresponding clevis hanger 57 as shown in FIGS. 4A and 4B. Pin 67 will then be inserted through a first clevis hanger bore 65, through bushing bore 71, and then through a corresponding second clevis hanger bore 65 of clevis hanger 57. Tensioner ring bushing 69 will substantially fill the gap of clevis hanger 57 and allow cylinder rod 51 to pivot in a vertical plane passing through an axis of cylinder rod 51. A tensioner pin cap 70 will then be secured to either end of pin 67, such as with bolts 68 threaded into corresponding bores of pin 67 or by any other suitable means. Tensioner pin caps 70 will have an outer diameter larger than the diameter of clevis hanger bore 65 such that an interior surface of each pin cap 70 will abut an exterior surface of clevis hanger bore 57, thereby securing pin 67 in bushing bore 71. Tensioner pin caps 70 are placed on exterior ends of pin 67. Tensioner ring bushing 69 will allow for flexation of cylinder rod 51 out of the vertical plane without undergoing catastrophic deformation.

Cylinder 25 couples to cylinder assembly attachment plate 23 as shown in FIG. 5. Swivel bearing 45 mounts within swivel bore 43 of cylinder assembly attachment plate 23 such that swivel bearing 45 substantially fills swivel bore 43. Swivel bearing 45 includes a swivel bearing housing 75, a swivel bearing bushing race 77, and swivel ball 79. A person skilled in the art will understand that swivel bearing housing 75 may be a separate component as shown or alternatively an integral component of cylinder assembly attachment plate 23. Swivel bushing race 77 mounts within swivel bearing housing 75 and retains swivel ball 79 while allowing swivel ball 79 to pivot along at least two axes originating from a center of swivel ball 79. Swivel ball 79 has a bearing bore 81 passing through a center of swivel ball 79. Bearing bore 81 has a diameter approximately equivalent to a diameter of swivel pin 47. Swivel pin 47 may insert through a clevis swivel bore 83. Clevis swivel bore 83 has a larger diameter than the diameter of swivel pin 47. A swivel hanger bushing 85 is interposed between swivel pin 47 and clevis hanger 33 within clevis swivel bore 83. When inserted into clevis swivel bore 83, clevis hanger bushing 85 will have an exterior end that is flush with an exterior surface of clevis hanger 33. An interior end of clevis hanger bushing 85 will abut an exterior surface of swivel ball 79. Similarly, exterior ends of swivel pin 47 will be flush with the exterior surface of clevis hanger 33 after insertion of swivel pin 47 through swivel ball 79.

Figure 6:
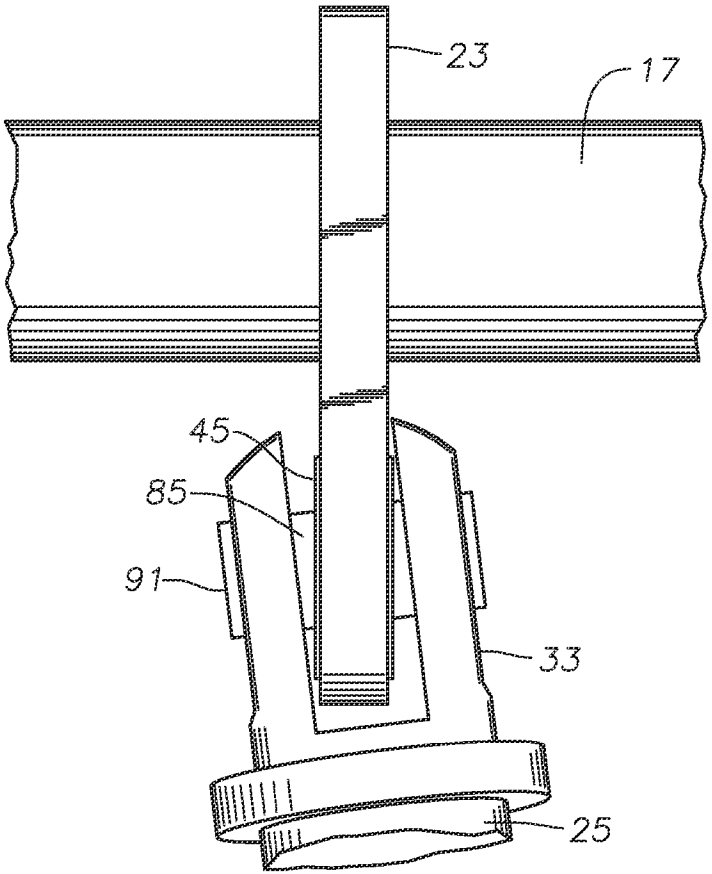
FIG. 6 is schematic representation of the mounting of the upper end of a cylinder to the riser tensioner system rotated from perpendicular to a riser tensioner frame ring of FIG. 1A.

Swivel pin 47 has bolt holes 87 formed in each end of pin 47. Bolt holes 87 are threaded so that a matching thread of a bolt 89 may thread into bolt holes 87. Pin caps 91 are placed on exterior ends of swivel pin 47. Pin caps 91 have a center bore for passage of bolts 89 and an outer diameter greater than the outer diameter of swivel hanger bushing 85 such that a portion of each pin cap 89 will abut the exterior of clevis hanger 33. When bolts 89 are threaded into bolt holes 87, swivel pin 47 will be secured between pin caps 91, and exterior ends of swivel hanger bushings 85 will abut pin caps 91, limiting lateral movement of swivel hanger bushing 85. Interior ends of swivel hanger bushings 85 will abut swivel bearing 79. In this manner, swivel hanger bushings 85 will remain centered within clevis hanger 33 and prevent clevis hanger 33 from contacting cylinder assembly attachment plate 23 during operation of riser tensioner system 11. As clevis hanger 33 attempts to slide laterally along swivel hanger bushings 85 from the position shown in FIG. 5, pin caps 91 will exert a reactive force on clevis hanger 33 preventing clevis hanger 33 from sliding along swivel hanger bushings 85. Similarly, cylinder assembly attachment plate 23 will be prevented from sliding laterally through the abutment of swivel hanger bushings 85 with swivel bearing 79. In this manner, cylinder 25 will be able to pivot on swivel pin 47 inboard and outboard relative to frame ring 17 (FIG. 1A), and to pivot on swivel bearing 79 to the left and right as shown in FIG. 6 without contact between cylinder assembly attachment plate 23 and clevis hanger 33, thereby reducing wear of riser tensioner system 11. A person skilled in the art will understand that the coupling system securing cylinder attachment plates 23 to cylinders 25 may alternatively be used to secure rods 51 to tensioner ring 53.

The current configuration also allows for removal of the pins maintaining each cylinder 25 to the cylinder assembly attachment plate 23 without further modification or disassembly of riser tensioner system 11, aiding in removal and replacement of cylinders 25 as needed. This is accomplished using a cylinder lifting tool and existing lifting equipment on location at an installation of riser tensioner system 11 without the need to bring a construction crane to the installation location. Furthermore, riser tensioner system 11 as disclosed herein is a complete system that may be manufactured, assembled, and tested at an offsite factory and then delivered to a subsea well platform or rig as a single unit. The existing equipment, i.e. cranes, etc., on location at the rig site are sufficient to lift riser tensioner system 11 and place it in a well slot on the platform without assistance from additional cranes or equipment not previously in place on the rig. In so doing, riser tensioner system 11 eliminates the necessity for the complex and relatively risky keel hauling process, wherein tensioner system 11, or a component such as cylinder assembly 25, is lowered over the outside of the platform, perhaps with a crane brought onsite specifically for the purpose, passed underneath the deck of the platform, and then raised through the riser opening into the platform's well slot. Similarly, other individual components of riser tensioner system 11 may be removed and replaced without keel hauling. In this manner, riser tensioner system 11 reduces onsite assembly and testing problems and expedites installation.

Figure 7A:
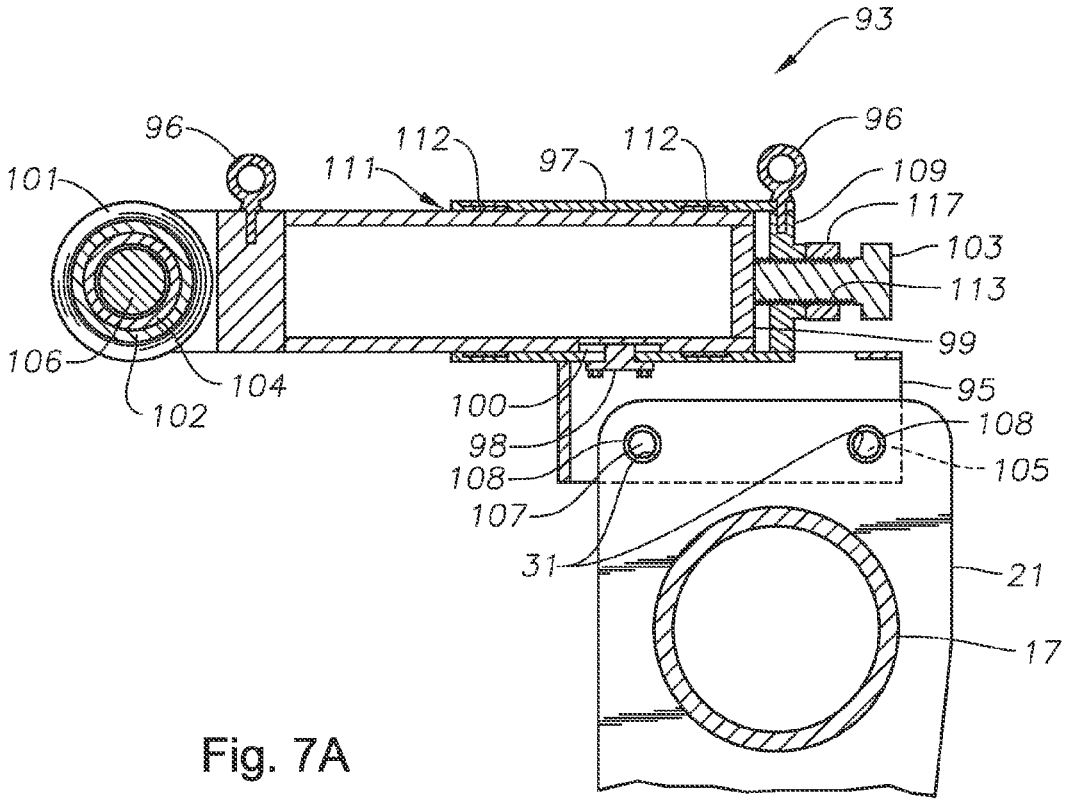
FIG. 7A is a sectional view of a riser centralizer of the riser tensioner system of FIG. 1A taken along line 7A-7A of FIG. 7B.
Figure 7B:
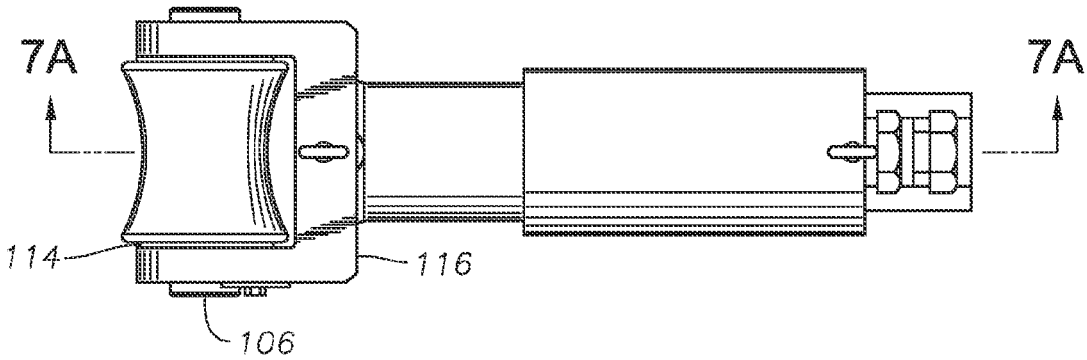
FIG. 7B is a top view of the riser centralizer of the riser tensioner system of FIG. 1A.
Figure 7C:
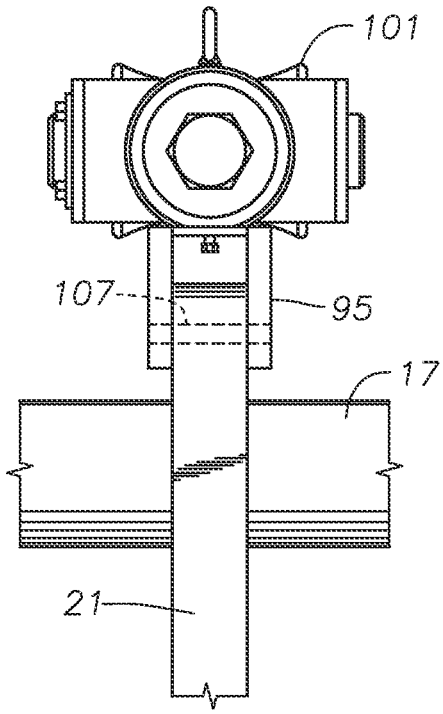
FIG. 7C is a right side view of the riser centralizer of the riser tensioner system of FIG. 1A.
Figure 7D:
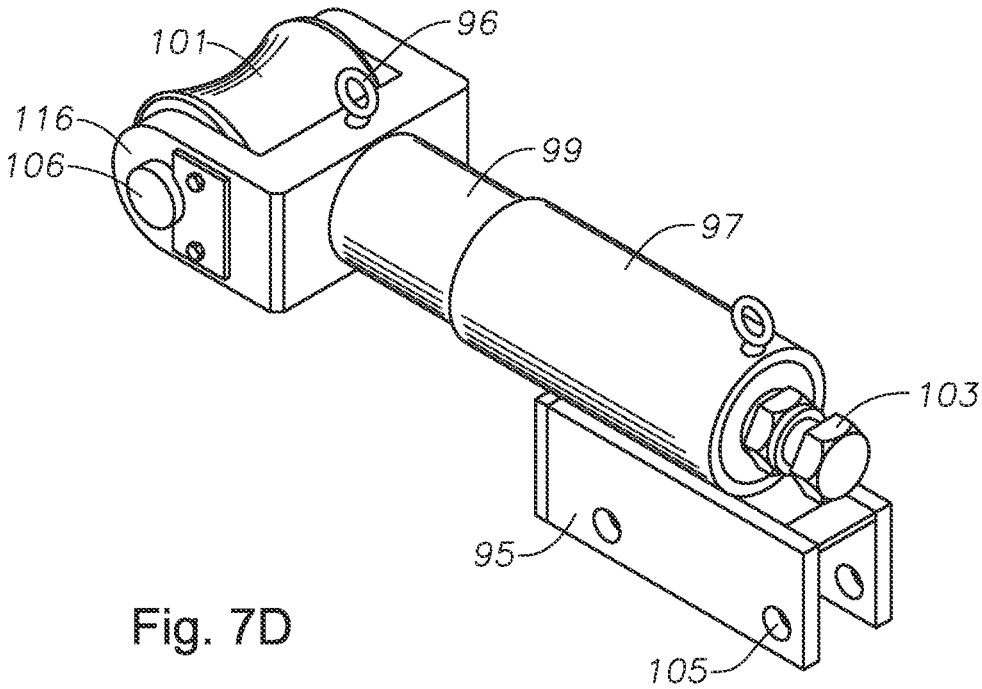
FIG. 7D is a perspective view of the riser centralizer of the riser tensioner system of FIG. 1A.

Referring now to FIG. 1A, riser centralizers 93 may be coupled to frame ring 17 at pin holes 31 on leg attachment plate 21 or pin holes 41 on cylinder assembly attachment plate 23. As illustrated in FIGS. 7A and 7C, riser centralizers 93 may couple to leg attachment plate 21 at pin holes 31. Bushings 108 may be mounted within pin holes 31 or pin holes 41 to aid in the removal of centralizer pins 107 when riser tensioner system 11 is serviced. Each riser centralizer 93 includes a mounting bracket 95, a centralizer housing 97, a centralizer arm 99, a centralizer roller 101, and an adjustment bolt or screw 103. Mounting bracket 95 may be a separate element or formed as an integral part of centralizer housing 97. Mounting bracket 95 has matching bore holes 105 that when placed on leg attachment plate 21 align with pin holes 31. Centralizer pins 107, or any other suitable device, may pass through pin holes 31 and bore holes 105 to secure mounting bracket 95 to leg attachment plate 21. A person skilled in the art will understand that with only one centralizer pin 107 inserted into one set of pin holes 31, riser centralizer 93 may pivot inboard and outboard relative to frame ring 17 when lifted using a lifting eye 96. Lifting eyes 96 comprise eyes coupled to upper exterior ends of centralizer housing 97. An external apparatus may be secured to centralizer housing 97 and operated to cause centralizer housing 97 and mounting bracket 95 to rotate about the one centralizer pin 107 inserted through a corresponding set of pin holes 31.

Centralizer housing 97 defines a centralizer arm chamber 109 into which centralizer arm 99 may be inserted. Centralizer arm 99 passes through an opening 111 at an end of centralizer housing 97. Opening 111 has a diameter approximately equal to the diameter of centralizer arm 99. Centralizer arm 99 may move laterally within centralizer housing 97. Centralizer housing 97 may include wear rings 112 at opening 111 and within centralizer arm chamber 109 interposed between centralizer housing 97 and centralizer arm 99. Wear rings 112 may comprise maintenance free low friction wear rings, or any other suitable wear element. The wear rings will reduce the wear on centralizer housing 97 and centralizer arm 99 during operation of centralizer 93, thereby extending the useful life of centralizer 93.

Centralizer housing 97 has an opening 113 opposite opening 111. Opening 113 has a diameter sufficient to accommodate passage of adjustment bolt 103. In the illustrated embodiment, opening 113 is threaded on an inner diameter of opening 113. Adjustment bolt 103 may thread into centralizer housing 97 through opening 113. An end of adjustment bolt 103 will abut an end of centralizer arm 99. Rotation of adjustment bolt 103 through the matching threads on adjustment bolt 103 and opening 113 will cause an end of adjustment bolt 103 to move alternatively into and out of centralizer housing 97. Adjustment bolt 103 may also thread through a jam nut 117 at opening 113 to prevent unintended rotation of adjustment bolt 103. As adjustment bolt 103 moves into centralizer housing 97, it will force centralizer arm 99 partially out of centralizer housing 97. When adjustment bolt 103 moves out of centralizer housing 97, centralizer arm 99 may be moved back further into centralizer housing 97. In this manner, roller 101 may be brought into contact with a riser after installation of riser centralizers 93. In addition, riser centralizers 93 may be adjusted as needed throughout the operative life of each riser centralizer 93.

Each centralizer arm 99 and centralizer housing 97 includes a key 98 and a corresponding slot 100 in centralizer arm 111 configured to limit the range of rotation of centralizer arm relative to centralizer housing 97. In addition, key 98 and slot 100 may be configured to limit the longitudinal travel of centralizer arm 99 relative to centralizer housing 97. Centralizer roller 101 may comprise a "V" roller surrounding a metallic sleeve 102 or a metallic "V" roller with a urethane or rubber coating on an exterior surface of centralizer roller 101 to prevent metal-to-metal contact with a riser. As used herein a "V" roller refers to a roller having a curved concave profile. Centralizer roller 101 will couple to a roller clevis 116 through roller central pin 106. Roller clevis 116 will further couple to centralizer arm 99, thereby securing centralizer roller 101 to centralizer arm 99. A replaceable maintenance free low friction bushing 104 may surround roller central pin 106 coupling roller 101 to centralizer arm 99. Maintenance free washers 114 may be interposed between roller 101 and roller clevis 116 to prevent wear of roller central pin 106 and a clevis 116 during operation of the riser tensioner system 11.

Riser centralizers 93 may be placed at any leg attachment plate 21 or cylinder attachment assembly plate 23, allowing for wide variation of and use of a plurality of riser centralizers 93 to accommodate any necessary amount of centralization force. In addition, unused pins 31 and 41 (FIGS. 2A and 3A) may be used as attachment points to lift and transport the completed riser tensioner system 11 into place on a platform deck. Still further, these points could be attachment points for decking, allowing for a working platform proximate to the riser.

Figure 8:
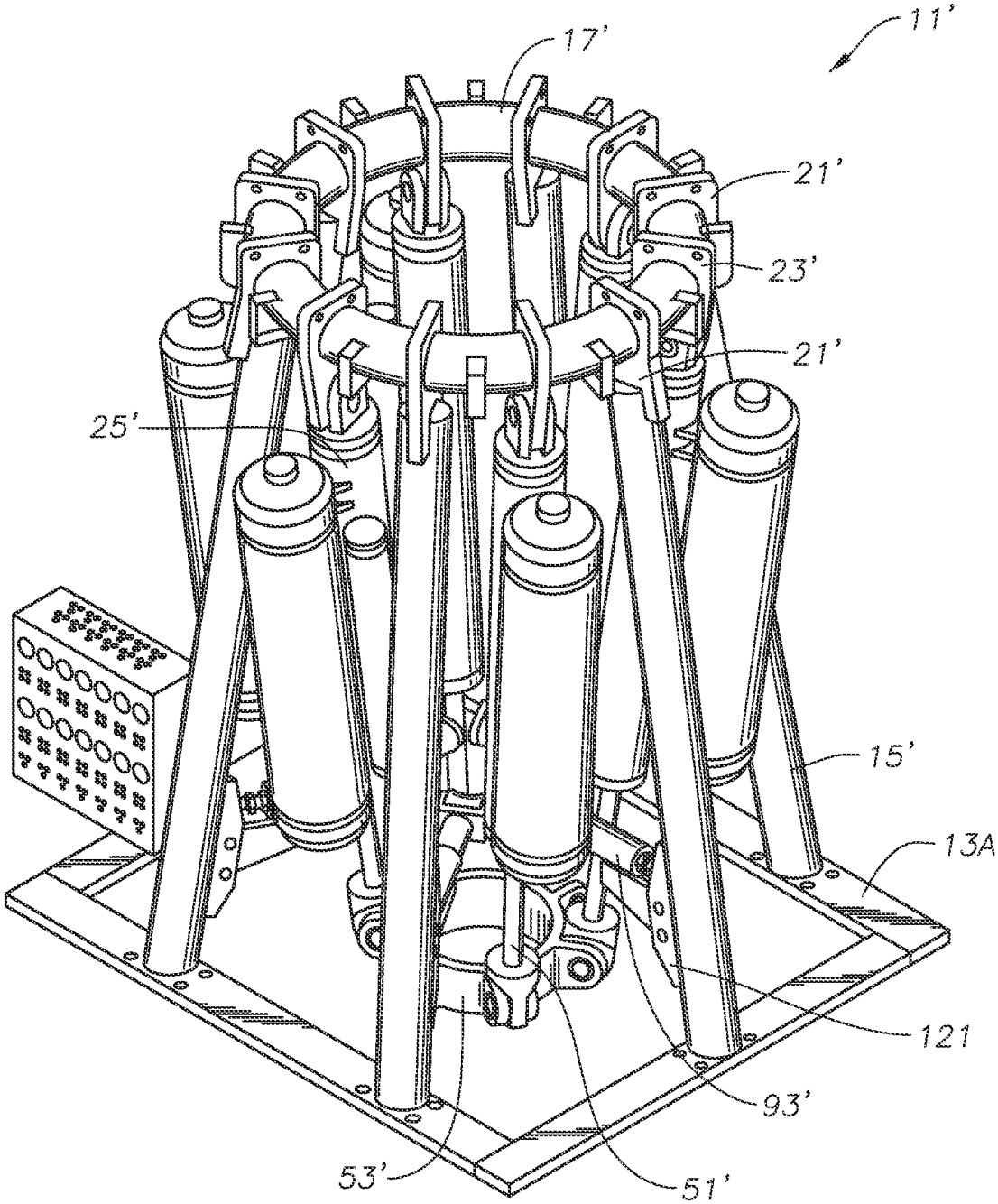
FIG. 8 is a schematic representation of an alternative riser tensioner system illustrating an alternative base and riser centralizer configuration.
Figure 9A:
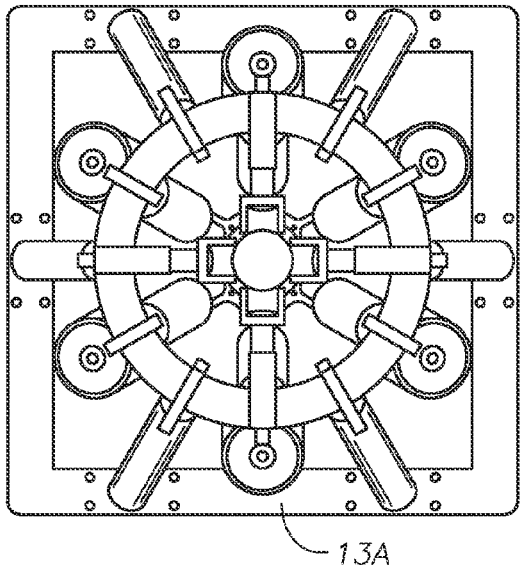
FIGS. 9A-9E are schematic representations of alternative base frame arrangements of the riser tensioner system of FIG. 1A.
Figure 9B:
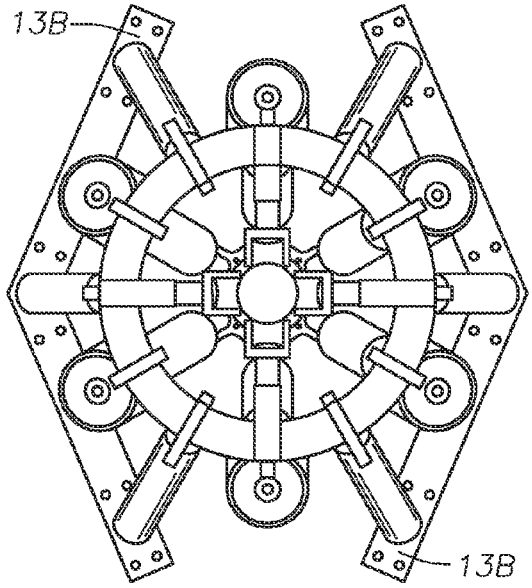
Figure 9C:
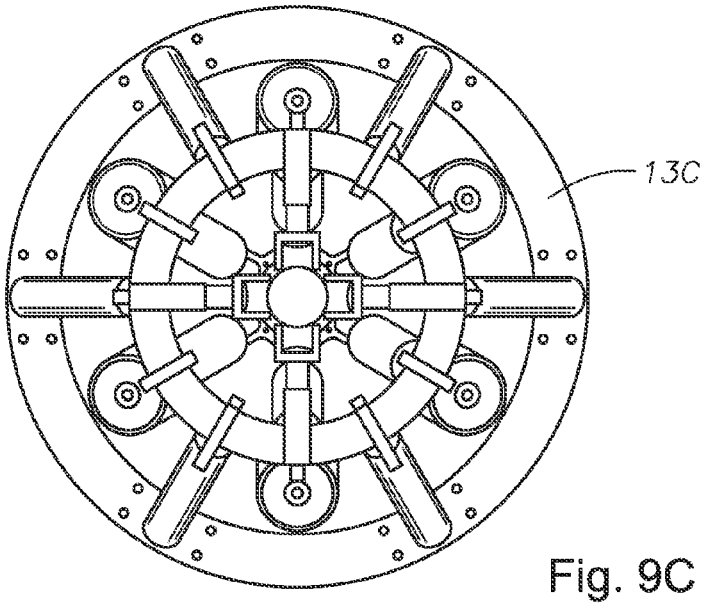
Figure 9D:
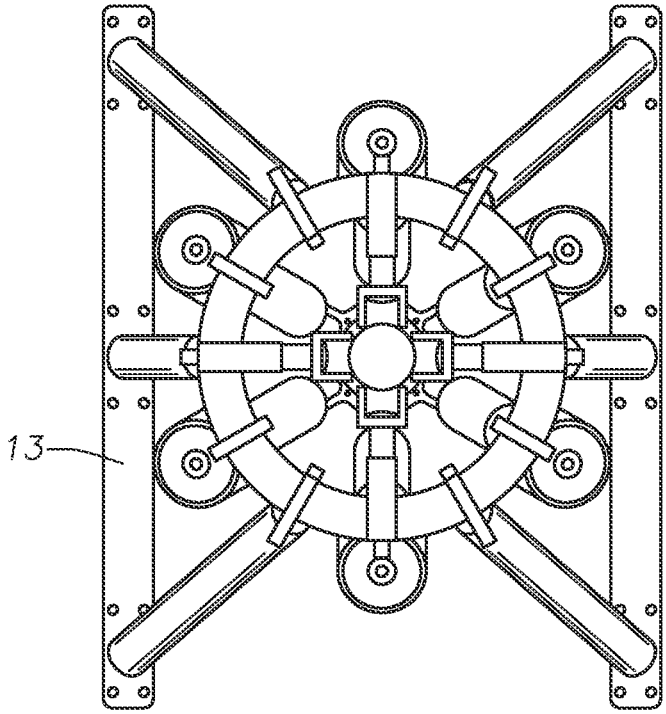
Figure 9E:
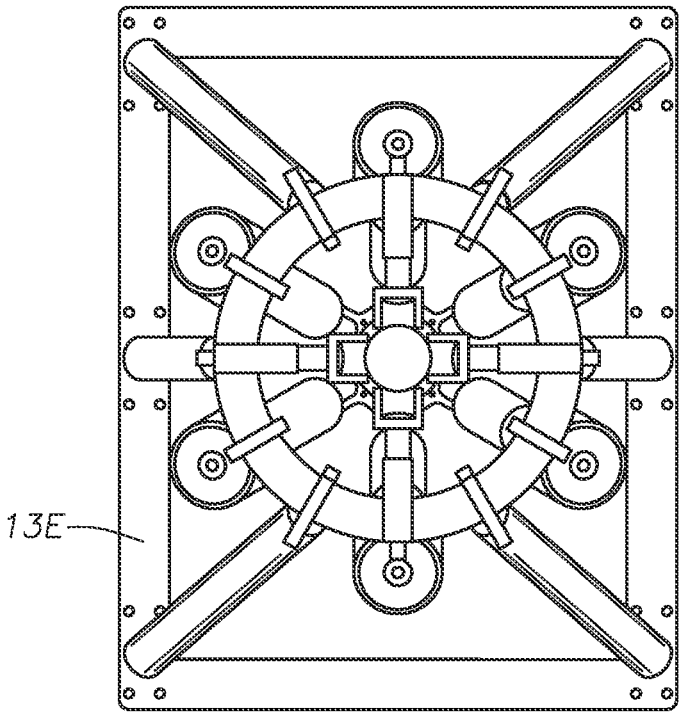

Referring now to FIG. 8, there is shown an alternative embodiment of the riser tensioner of FIG. 1A. Riser tensioner system 11' is an alternative embodiment of riser tensioner system 11. Riser tensioner 11' includes the components and assemblies of FIG. 1A modified as described below. Base frame 13A may be a square frame in the alternative embodiment with frame legs 15' spaced around all four sides of frame 13A. Frame legs 15', frame ring 17', cylinders 25', and tension ring 53' couple as described above with respect to FIG. 1A. Riser centralizers 93' couple to a centralizer leg bracket 121. Leg Bracket 121 mounts directly to frame leg 15' in any suitable manner, such as by welding. Leg bracket 121 includes a portion extending inboard toward a center of frame ring 17' for mounting of riser centralizer 93'. Riser centralizer 93' mounts to leg bracket 121 similar to that of riser centralizer 93 to leg attachment plate 21 or cylinder assembly attachment plate 23 of FIG. 1A. The alternative embodiment provides a mounting point for a riser centralizer that will react to strong bending moments that may be encountered during extreme operations such as during non-ideal weather or current conditions. Furthermore, the alternative embodiment allows for mounting of riser centralizers at both leg bracket 121 and leg attachment plates 21 and cylinder assembly attachment plates 23. This will ensure that the motion of the riser is limited to vertical motion relative to the platform.

Accordingly, the disclosed embodiments provide numerous advantages. For example, the resulting tensioner system's height is less than one that utilizes prior art designs, such as those using dual shackles to couple the cylinders to the frame. This decreases the required vertical spacing between decks on a platform, allowing for minimal vertical spacing of the decks. The riser tensioner system is a complete put-together assembly, function and pressure tested prior to shipment to an offshore facility. This eliminates costly offshore assembly and possible system damage and contamination due to the offshore environment. The disclosed embodiments also allow for installation and repair of the riser tensioner system without the need of a risky keel hauling process. Thus, on platforms with multiple installed risers, the riser tensioner system disclosed herein may be installed, repaired, or removed without shutting in production through the platform during the process as may otherwise be required during a standard keel hauling process.

Unlike prior art designs, the primary load path of the disclosed tensioner passes directly from the frame, through the leg attachment plate and into the frame leg, without placing primary structural load bearing on the joining welds mounting each element to the next. This provides a stronger more efficient frame structure. It is more efficient in transferring loads, less sensitive to deflection induced stress hot-spots, easier to fabricate and inspect, and less expensive. In addition, mounting the pivoting member, i.e. the swivel bearing, to the stationary tensioner frame will cause the tensioning loads to remain perpendicular to the pivoting member and the tensioner frame, thereby eliminating eccentric loading of the pivoting mount.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tensioner for maintaining a tensile force in a riser having an axis and extending from a subsea wellhead assembly through an opening in a floating platform deck, the tensioner comprising:

a plurality of tensioner legs, each having a lower end for mounting to the deck;

a circular support ring formed of at least one curved segment positioned proximate to upper ends of the tensioner legs;

a plurality of leg attachment plates, each having an opening formed therethrough, the support ring passing through the opening in each leg attachment plate so that each leg attachment plate is proximate to a respective one of the tensioner legs;

a slot formed in the upper end of each tensioner leg, each slot corresponding to one of the leg attachment plates, and a lower end of each leg attachment plate mounted in one of the corresponding slots;

a tensioner ring axially below the support ring for engaging the riser;

a plurality of cylinders extending between the support ring and the tensioner ring;

an upper end of each cylinder pivotally mounted to the support ring; and a lower end of each cylinder adjustably mounted to the tensioner ring.

2. The tensioner of claim 1, wherein the tubular support ring comprises a plurality of curved segments welded together at each end of each curved segment, each end of each curved segment being coplanar with a radius of the tubular support ring.

3. The tensioner of claim 1, further comprising:

a plurality of cylinder attachment plates, each having an opening formed therethrough, the support ring passing through the opening in each of the cylinder attachment plates so that each cylinder attachment plate is proximate to a respective one of the cylinders; and an upper end of each cylinder mounted to a corresponding one of the cylinder attachment plates so that the cylinder may pivot about a mounting point.

4. The tensioner of claim 3, wherein each cylinder attachment plate comprises:

an upper edge;

a pair of side edges extending from and substantially perpendicular to the upper edge;

a radiused lower edge joining the side edges, the lower edge having a radius less than one half a length of the upper edge so that one of the pair of side edges includes a taper from the upper edge to the radiused bottom edge; and a swivel bore proximate to the lower edge, the swivel bore having an axis offset from an axis of the opening of the cylinder attachment plate.

5. The tensioner of claim 4, wherein a load path of a cylinder is perpendicular to the axis of the swivel bore and the axis of the opening so that loading of the support ring passes through an axis of the tubular portion of the support ring.

6. The tensioner of claim 1, wherein each leg attachment plate further comprises an upper portion having a sloped surface so that the sloped surface is substantially horizontal when each leg attachment plate is mounted to the support ring and a respective one of the legs.

7. The tensioner of claim 1, wherein each tensioner leg is aligned with the leg attachment plate attached thereto so that an axial load applied to the support ring will transfer through the leg attachment plate and the tensioner leg to the deck along an axis of the tensioner leg.

8. The tensioner of claim 1, wherein each leg attachment plate has two holes bored through an upper end of the attachment plate axially above the support ring opening so that additional devices may mount to the tensioner.

9. The tensioner of claim 1, wherein the upper cylinder mounting comprises a clevis coupling, the clevis coupling comprising:

a u-shaped coupler mounted to the upper end of the cylinder having a pair of legs, each containing bores formed in either leg and aligned with one of the bores on the other leg;

a swivel bearing mounted in the cylinder attachment plate axially beneath the tubular support ring, the swivel bearing having a bore aligned with the bores of the u-shaped coupler; and a cylinder pin passed through the u-shaped coupler bores and the swivel bearing bore.

10. The tensioner of claim 9, further comprising:

a pair of placement sleeves, each having an interior diameter equivalent to the exterior diameter of the cylindrical pin, and an exterior diameter equivalent to the diameter of the u-shaped coupler bores, the placement sleeves having interior ends abutting the swivel bearing and exterior ends flush with an outer surface of the adjacent u-shaped coupler; and a pair of sleeve caps mounted to opposite ends of the cylindrical pin, securing the sleeves in position between the swivel bearing and the adjacent u-shaped coupler.

11. The tensioner of claim 1, further comprising a base frame assembly having at least two rail members for mounting to the deck, at least two of the legs mounted side by side to each of the rail members.

12. The tensioner of claim 1, further comprising a lateral guidance assembly having a plurality of centralizers mounted to the tubular support ring to constrain lateral shift, each centralizer comprising:

a mounting bracket pivotably mounted to at least one of the leg attachment plates and one of the cylinder attachment plates, two or more pins passing through separate bores of the bracket to pass through corresponding bores in the leg attachment plate and the cylinder attachment plate, at least one of the pins being removable to allow the mounting bracket to pivot on another of the two or more pins; and a centralizer arm adjustably mounted to the mounting bracket so that the centralizer arm is moveable relative to the mounting bracket, the centralizer arm having a roller on an interior end to engage an outer diameter surface of the riser to resist lateral movement of the riser.

13. The tensioner of claim 12, wherein the centralizer arm is adjustable while under a load.

14. A tensioner for maintaining a tensile force in a riser having an axis and extending from a subsea wellhead assembly through an opening in a floating platform deck, the tensioner comprising:

a circular support ring formed of at least one curved segment;

a plurality of tensioner legs, each having an upper end for mounting to the support ring;

a base frame having at least two linear members for mounting to the deck, each linear member having lower ends of at least two legs rigidly mounted thereto;

a plurality of leg attachment plates, each having an opening formed therethrough, the support ring passing through the opening in each leg attachment plate so that each leg attachment plate is proximate to a respective one of the tensioner legs;

a plurality of cylinders extending between the support ring and the riser; and a plurality of centralizers mounted to the support ring and extending radially inward to constrain lateral shift, each centralizer including a roller on an interior end for engaging the riser.

15. The tensioner of claim 14, further comprising:

a slot formed in the upper end of each tensioner leg, each slot corresponding to one of the leg attachment plates, and a lower end of each leg attachment plate mounted in one of the corresponding slots.

16. The tensioner of claim 14, further comprising:

a tensioner ring axially below the support ring for mounting to the riser;

a plurality of cylinder attachment plates, each having an opening formed therethrough, the support ring passing through the opening in each of the cylinder attachment plates so that each cylinder attachment plate is proximate to a respective one of the cylinders;

each of the plurality of cylinders having an upper end pivotally mounted to a corresponding one of the cylinder attachment plates; and a lower end of each cylinder adjustably mounted to the tensioner ring each centralizer including:

a mounting bracket pivotably mounted to at least one of a leg attachment plate and a cylinder attachment plate, two or more pins passing through separate bores of the bracket to pass through the bores the upper end of the leg attachment plate and the cylinder attachment plate, at least one of the pins removable to allow the mounting bracket to pivot on another of the two or more pins.

17. The tensioner of claim 16, wherein an upper end of each cylinder mounted with a clevis coupling to a corresponding cylinder attachment plate, the clevis coupling comprising:

a u-shaped coupler mounted to the upper end of the cylinder having a pair of legs, each containing bores formed in either leg and aligned with one of the bores on the other leg;

a swivel bearing mounted in the cylinder attachment plate axially beneath the tubular support ring, the swivel bearing having a bore aligned with the bores of the u-shaped coupler; and a cylinder pin passed through the u-shaped coupler bores and the swivel bearing bore.

18. The tensioner of claim 17, further comprising a lower end of each cylinder adjustably mounted with a composite sleeve to the tensioner ring.

19. The tensioner of claim 17, further comprising:

a pair of placement sleeves, each having an interior diameter equivalent to the exterior diameter of the cylindrical pin, and an exterior diameter equivalent to the diameter of the u-shaped coupler bores, the placement sleeves having interior ends abutting the swivel bearing and exterior ends flush with an outer surface of the adjacent u-shaped coupler; and a pair of sleeve caps mounted to opposite ends of the cylindrical pin, securing the sleeves in position between the swivel bearing and the adjacent u-shaped coupler.

20. The tensioner of claim 14, wherein each centralizer further comprises:

a plurality of cylinder attachment plates;

a plurality of leg attachment plates;

a mounting bracket pivotably mounted to at least one of the leg attachment plates and one of the cylinder attachment plates, two or more pins passing through separate bores of the bracket to pass through corresponding bores in the leg attachment plate and the cylinder attachment plate, at least one of the pins being removable to allow the mounting bracket to pivot on another of the two or more pins; and a centralizer arm adjustably mounted to the mounting bracket so that the centralizer arm is moveable relative to the mounting bracket, the centralizer arm having a roller on an interior end to engage an outer diameter surface of the riser to resist lateral movement of the riser, the centralizer arm adjustable while under a load.

21. The tensioner of claim 14, wherein the tubular support ring comprises a plurality of curved segments welded together at each end of each curved segment, each end of each curved segment being coplanar with a radius of the tubular support ring.

22. A tensioner for maintaining a tensile force in a subsea riser comprising:

a support ring formed of at least one curved segment;

a plurality of leg attachment plates slidably mounted on the support ring;

a plurality of tensioner legs each having a lower end that selectively mounts to a deck of a floating platform and an upper end coupled with a one of the leg attachment plates;

a tensioner ring generally coaxial with the support ring and in selective engagement with the riser; and a plurality of tensioning elements having upper ends depending from the support ring and lower ends coupled with the tensioner ring.

* * * * *